US006477998B1

(12) United States Patent
Nguyen

(10) Patent No.: US 6,477,998 B1
(45) Date of Patent: Nov. 12, 2002

(54) CAM ACTUATED CONTINUOUS SIMULTANEOUSLY VARIABLE VALVE TIMING AND LIFTING ASSEMBLY

(76) Inventor: Chinh T. Nguyen, 2157 Belding Ct., Okemos, MI (US) 48864

( * ) Notice: Subject to any disclaimer, the term of this patent is extended or adjusted under 35 U.S.C. 154(b) by 0 days.

(21) Appl. No.: 10/104,431

(22) Filed: Mar. 22, 2002

Related U.S. Application Data

(62) Division of application No. 09/761,215, filed on Jan. 16, 2001, now Pat. No. 6,446,589.

(51) Int. Cl.[7] ..... F01L 13/00; F01L 1/18

(52) U.S. Cl. ..... 123/90.16; 123/90.39; 74/559

(58) Field of Search ..... 123/90.15, 90.16, 123/90.39, 90.41, 90.42, 90.44; 74/519, 559

(56) References Cited

U.S. PATENT DOCUMENTS 4,841,799 A * 6/1989 Entzminger ..... 74/522
5,197,447 A * 3/1993 Dick ..... 123/557
5,349,929 A * 9/1994 Shimizu et al. ..... 123/90.16
5,572,962 A * 11/1996 Riley ..... 123/90.16
5,791,306 A * 8/1998 Williamson ..... 123/90.16
5,809,951 A * 9/1998 Kim ..... 123/90.16
5,899,180 A * 5/1999 Fischer ..... 123/90.16

* cited by examiner

*Primary Examiner*—Weilun Lo
(74) *Attorney, Agent, or Firm*—George P. Pappas

(57) ABSTRACT

A cam actuated continuous simultaneously variable valve timing and lifting assembly for selectively operating the valve of an internal combustion engine. The valve is actuated by a cam on a camshaft driven by a crankshaft. The cam is in operative engagement with a slider. The slider is selectively movable by a slider actuator within a rocker arm. The slider actuator is selectively extended and retracted by a first motor drive unit. A computer controller operatively controls the motor drive unit to selectively and simultaneously vary the timing and lifting of the valve. A modification of the invention is provided with a second motor drive unit provided with a downwardly extending hexagonal transfer shaft drive assembly having a downwardly extending spherical ball which operatively engages a rocker arm assembly provided with a slider thereon to accommodate the movement of the slider as needed. Another modification of the invention is provided wherein the second motor drive unit is provided with a downwardly extending selectively rotatable screw type rotary driving gear in selective operating engagement with the rotary driven gear which engages the rocker arm to operate the slider as needed.

2 Claims, 9 Drawing Sheets

CAM ACTUATED CONTINUOUS SIMULTANEOUSLY VARIABLE VALVE TIMING AND LIFTING ASSEMBLY

This application is a Division of Ser. No. 09/761,215, filed Jan. 16, 2001 now U.S. Pat. No. 6,446,589.

This invention relates to a cam actuated continuous simultaneously variable valve timing and lifting assembly for operating the valves of an internal combustion engine.

Further, this invention relates to a cam actuated continuous simultaneously variable valve timing and lifting assembly provided in operative engagement with a rocker arm so as to be cam actuated at one end thereof and to be in operative engagement with a spring loaded valve lifter at the opposite end thereof.

Further, this invention utilizes a slider provided with teeth which coacts with a rotating gear, connecting rod and actuator so as to keep distance between a roller and rocker arm shaft pivot at any desired distance and at any desired time.

Still further, this invention also provides for cam actuated continuous simultaneously changing timing and valve lifting distance as desired.

In addition, this invention changes timing and lifting simultaneously so that the changes occur continuously as desired.

Further, this invention can be adapted so as to be used on intake and exhaust valves as desired. This invention can also easily be adapted to any engines with rocker arms and overhead cams.

The use of this cam actuated continuous simultaneously variable valve timing and lifting assembly will create an engine that can perform to achieve the desired horsepower and torque at any RPM with the most efficiency in terms of horsepower and/or fuel economy.

Another embodiment of this invention comprises a hexagonal shaft having a spherical end portion which coacts with a rotating gear to actuate the movement of the slider as desired.

None of the known prior art engine valve driving devices have a capacity of the instant invention which provides cam actuated continuous simultaneously variable timing and lifting valve capability as desired.

It is therefore an object of this invention to provide a cam actuated continuous simultaneously variable valve timing and lifting assembly for operating the valves of an internal combustion engine.

Since the inception and development of internal combustion engines used to power vehicles such as boats, automobiles, racing cars and the like, it has been the goal to achieve more power and fuel economy in the same engine.

In the late 20s and early 30s, "hot rods" and the like ruled the streets. However, as automobile racing came on stream, racing car engine designers developed more powerful engines by incorprating larger displacements through the use of bored-out cylinders, larger valves to provide more combustion air into the cylinders, thus achieving more power from the engines.

Thus agressive cam action with higher lift, advance timing is a must in car racing to obtain maximum power from the racing car engine.

However, the drawbacks of such design changes is a rough engine and less fuel economy especially at low RPM operations.

Various combustion engine manufacturers such as Honda, Porsche and Lexus have tried to eliminate such drawbacks.

The Honda design tries to solve the problem by employing two cam lobes and two hydraulic lifters per valve. At low RPM, one lifter is pressurized to engage low lifting and less advance in timing to obtain smooth running and more torque. At higher RPM, the other lifter will be pressurized and take over the resultant advance in timing and more lift enables the same engine to produce more horsepower and higher RPM. At no time is there continuous change of timing and lifting.

Porsche attempts to advance timing by putting tension on one side of the timing belt or chain. Here again there is not change of lifting.

Lexus attempts to advance timing with the use of a device at the head of the camshaft by turning the camshaft ahead of the cam sprocket. Here there is no change of lifting.

In summary, none of the known prior art devices have a cam actuated continuous simultaneously variable valve timing and lifting assembly which operates at a continuous rate as desired at any moment such as utilized in the instant invention. This is achieved by the use of a pre-programmed computer controller unit whereby the engine can simultaneously reduce timing and lifting at low RPM and continuous simultaneous advance timing and lifting action as the engine increases RPM. The instant invention can reduce part of timing simultaneously with lifting to achieve fuel economy once the desired speed of the vehicle is reached.

For example, when a vehicle is required to accelerate to 70 MPH, the engine needs to produce all the power it can to achieve 70 MPH with the minimum time required. Once the desired speed is reached, the engine can reduce the timing simultaneously with the lifting to produce just enough power to maintain the desired MPH with resultant greater fuel economy.

Other objects and advantages found in the construction of the invention will be apparent from a consideration in connection with the specification description, the accompanying claims and the accompanying drawings.

IN THE DRAWINGS

Figure 8:
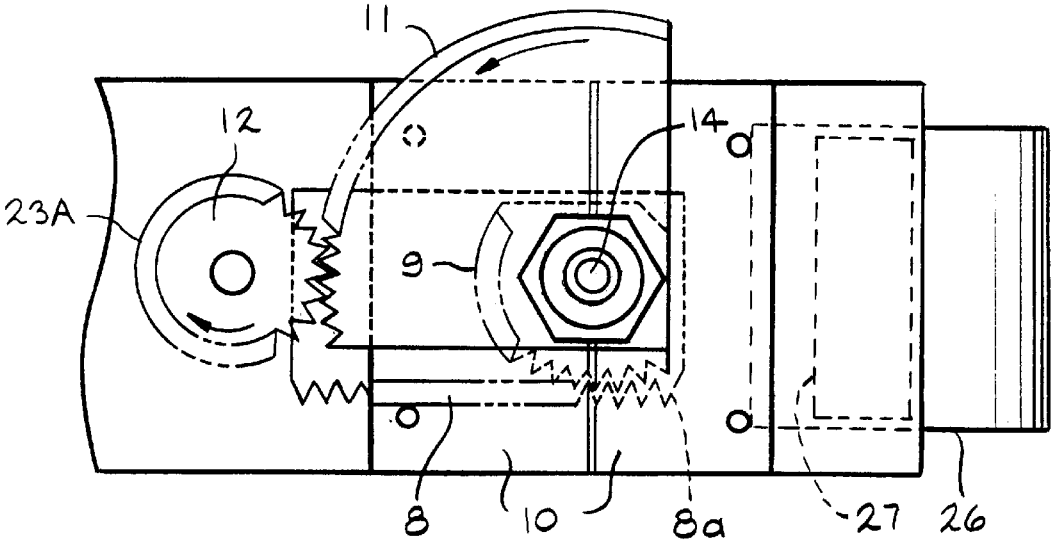
FIG. 8 is a top schematic view of a first modified embodiment of the invention showing the hexagonal transfer shaft drive assembly which coacts with a rotating gear to selectively actuate the slider assembly.
Figure 8A:
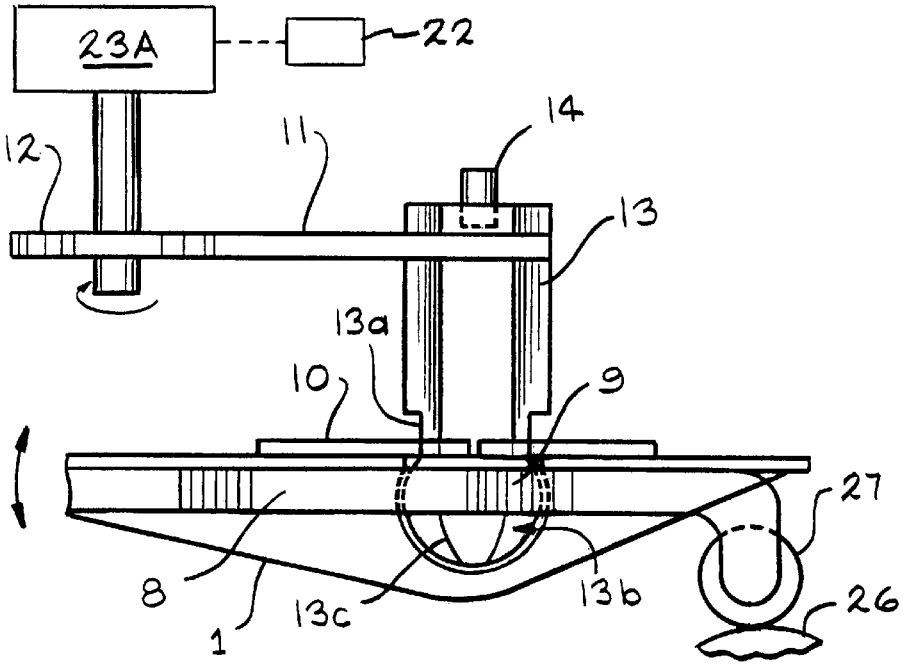

FIG. 8*a* is a front elevational schematic view of the first embodiment of the invention as shown in FIG. 8.

Figure 9:
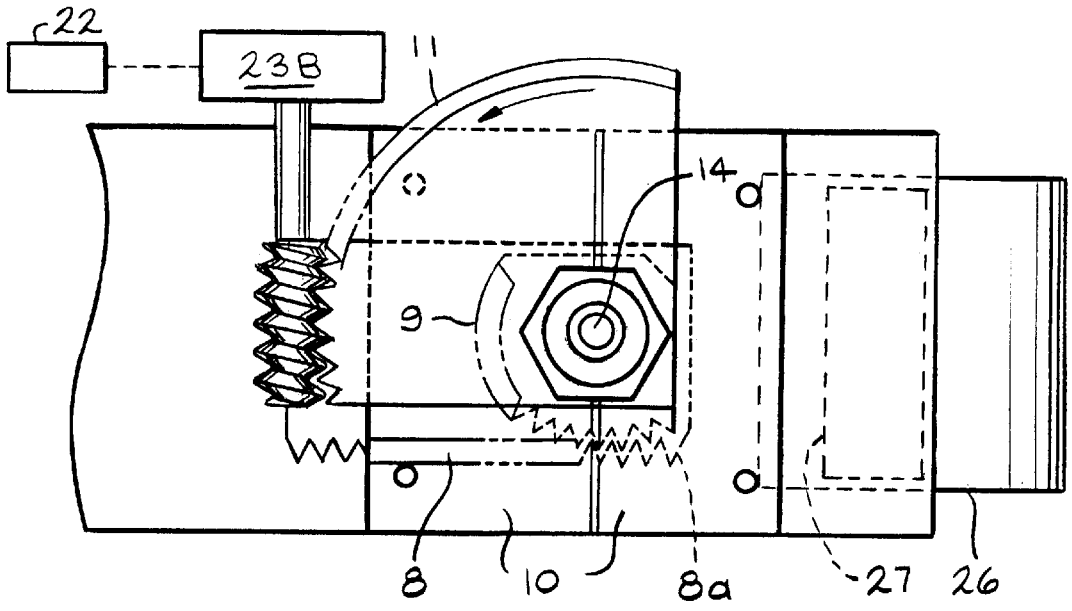

FIG. 9 is a top schematic view of a second modified embodiment of the invention showing the hexagonal transfer shaft drive assembly which coacts with a rotating gear to selectively actuate the slider assembly.

Figure 9A:
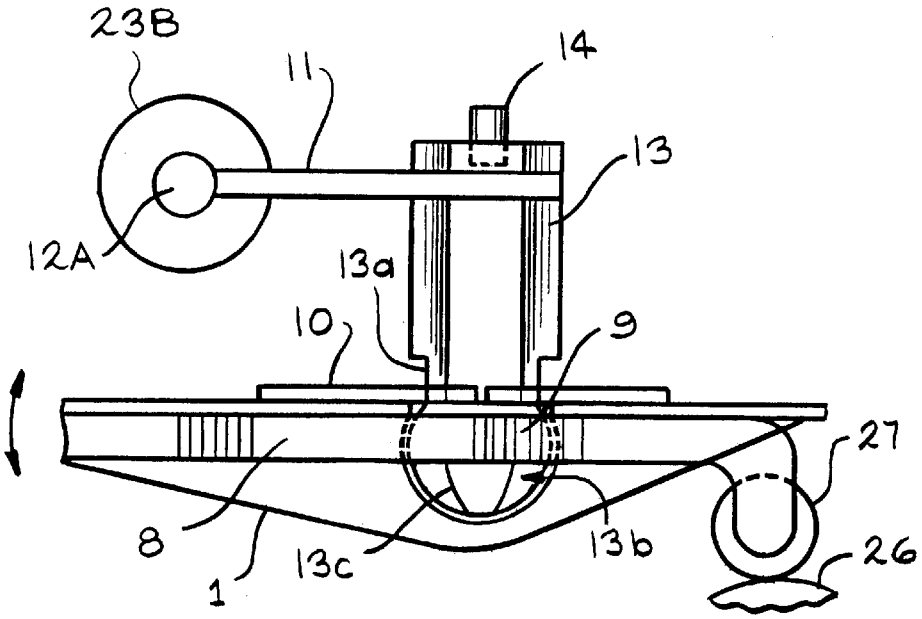

FIG. 9*a* is a front elevational view of the second embodiment of the invention as shown in FIG. 9.

Figure 10:
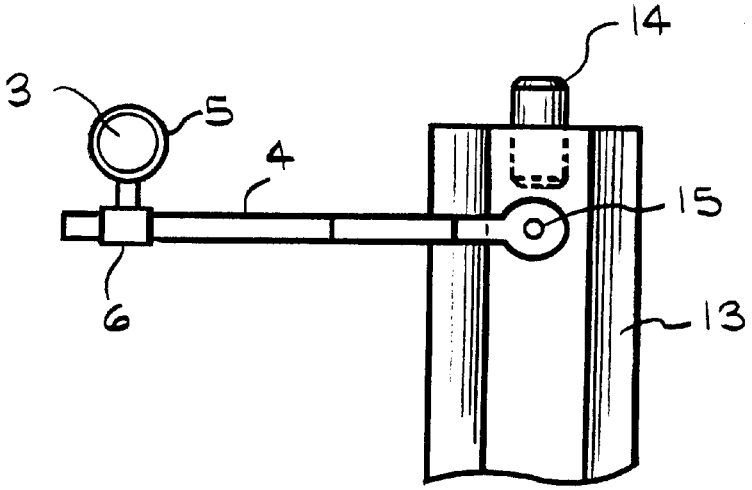

FIG. 10 is a partial schematic side elevational view of a modified bifurcated connecting rod in operative engagement with the hexagonal transfer shaft.

Figure 11:
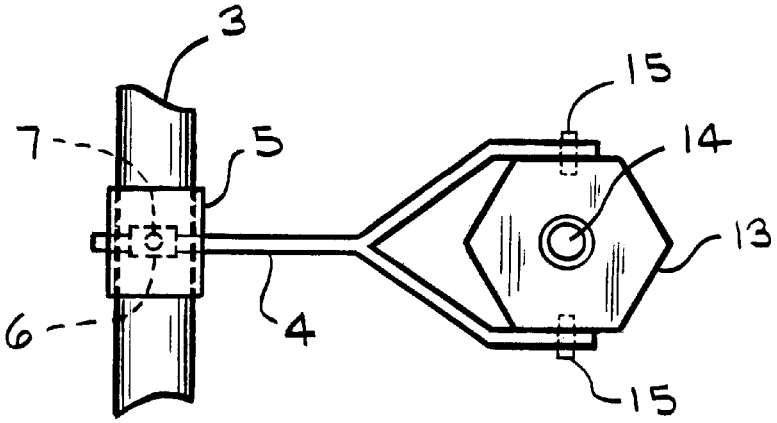

FIG. 11 is a top view of the embodiment as shown in FIG. 10.

Figure 12:
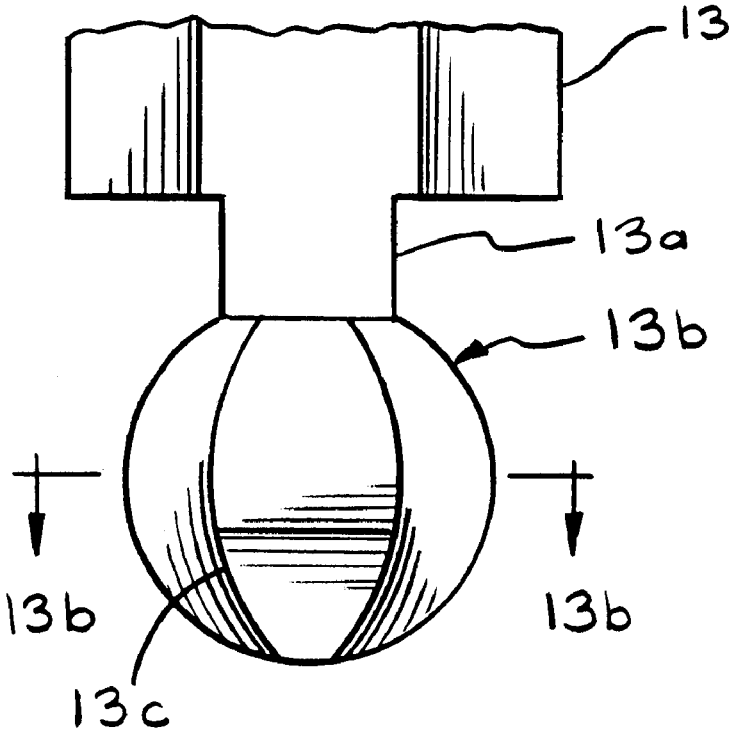

FIG. 12 is an enlarged schematic partial view of the lower portion of the hexagonal transfer shaft assembly with its spherical ball extension as shown in FIG. 8*a*.

Figure 13:
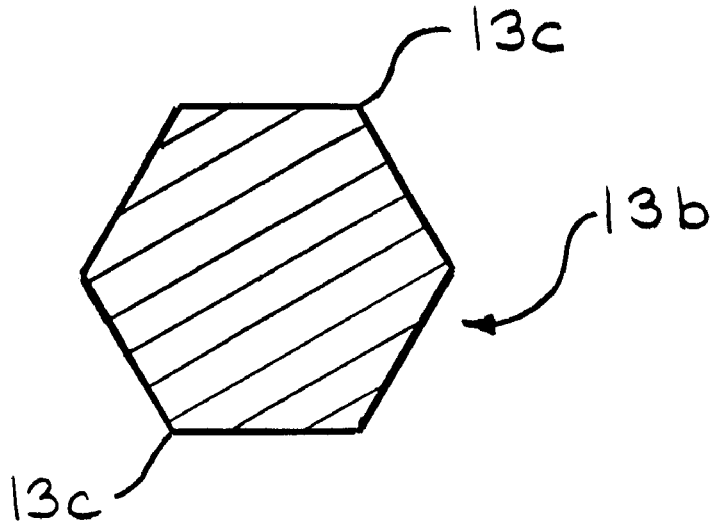

FIG. 13 is a schematic cross-sectional view taken on line 13*b*—13*b* of FIG. 12 showing the spherical ball extension of the hexagonal transfer shaft.

DESCRIPTION

Figure 1:
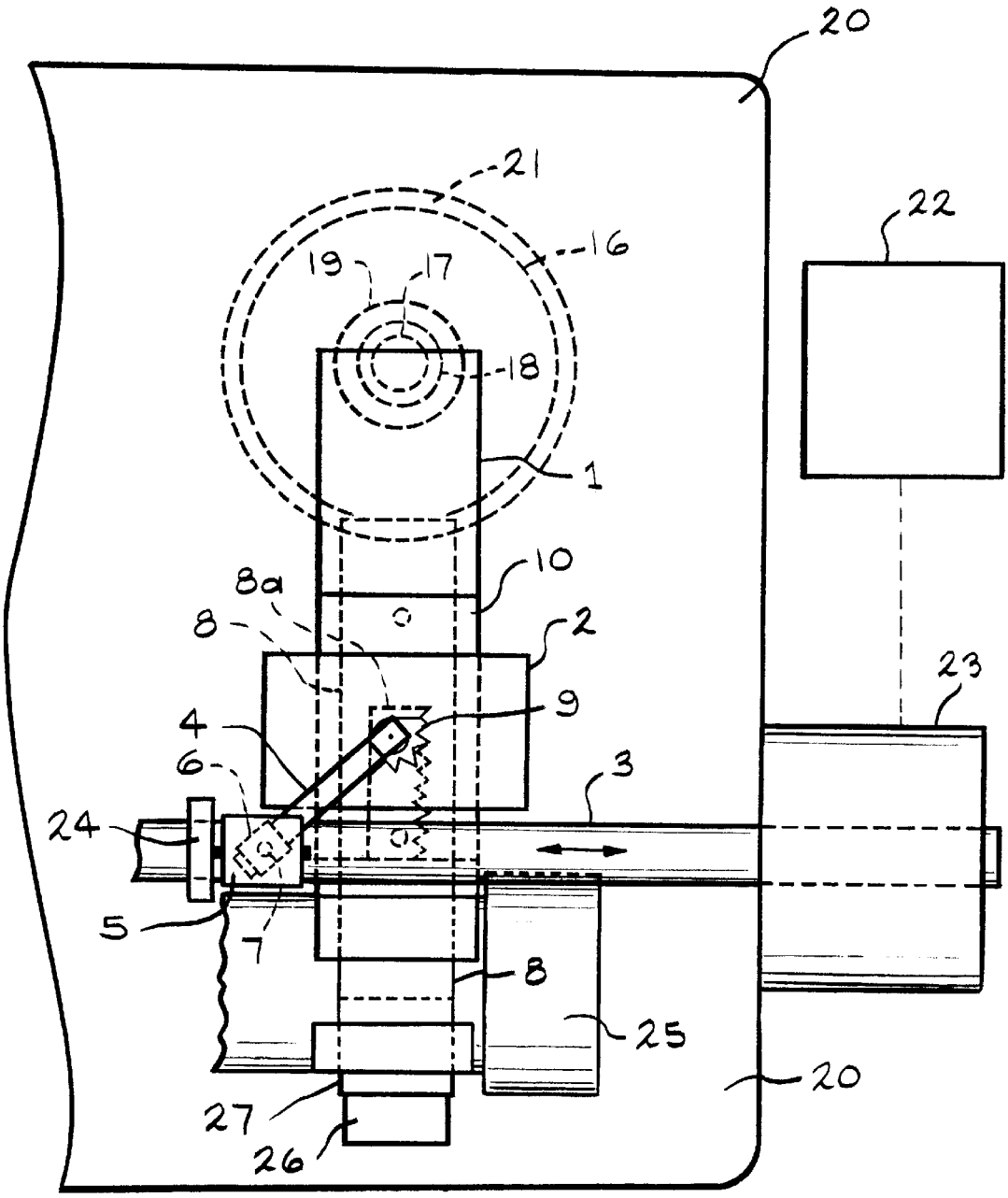
FIG. 1 is a schematic top view of the cam actuated continuous simultaneously variable valve timing and lifting assembly.

As shown in the schematic top view of FIG. 1, an embodiment of the cam actuated continuous simultaneously variable valve-timing and lifting assembly mounted on the cylinder head 20.

Figure 2:
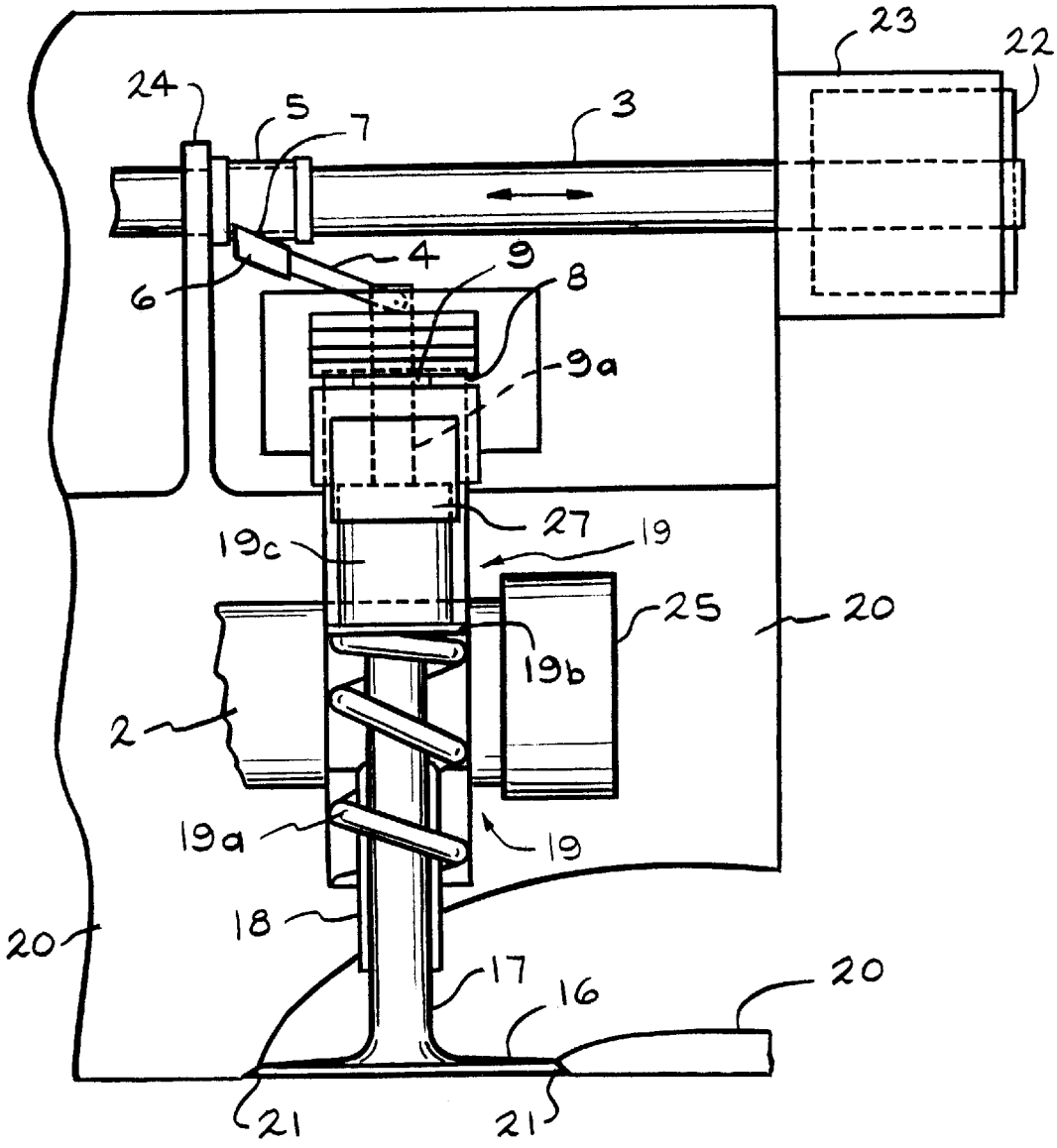
FIG. 2 is a schematic front elevational view of the cam actuated continuous simultaneously variable valve timing and lifting assembly.

As further shown in the front elevational view of FIG. 2, a pre-programmed computer controller unit 22 is provided in operative controlling engagement with a motor 23 so as to control the motor 23 as desired. Thus controlled, the motor 23 is adapted to selectively extend and retract the actuator 3 which selectively actuates the cam actuated continuous simultaneously variable valve timing and lifting assembly as will be hereinafter described.

As further shown in the schematic front elevational view of FIG. 2, the cam actuated continuous simultaneously variable valve timing and lifting assembly is in its operative use engagement with the standard valve assembly 19 provided in the cylinder head 20.

The standard valve assembly 19 is slidably positioned in the cylinder body 20 and is comprised of a lifter 19*c*, a spring retainer 19*b*, a spring 19*a*, a valve stem guide 18 and a valve stem 17 and a valve 16.

Figure 3:
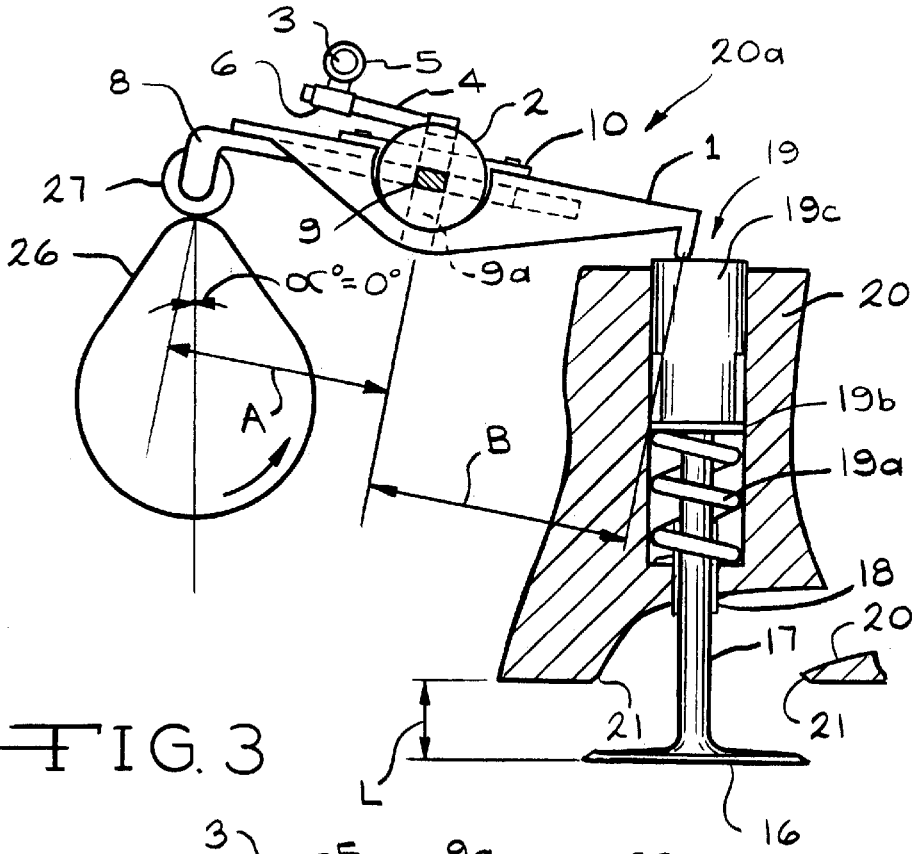
FIG. 3 is a schematic front elevational view of the cam actuated continuous simultaneously variable valve timing and lifting assembly in its normal open valve position.
Figure 4:
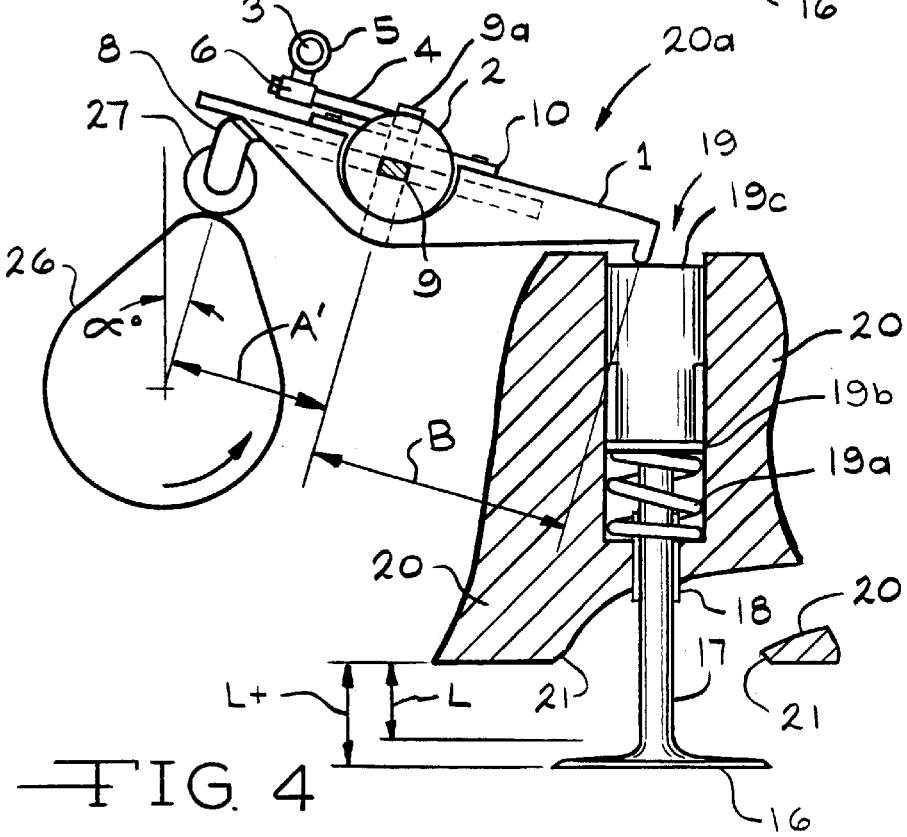
FIG. 4 is a schematic front elevational view of the cam actuated continuous simultaneously variable valve timing and lifting assembly in its advanced timing and lifting open valve position.
Figure 5:
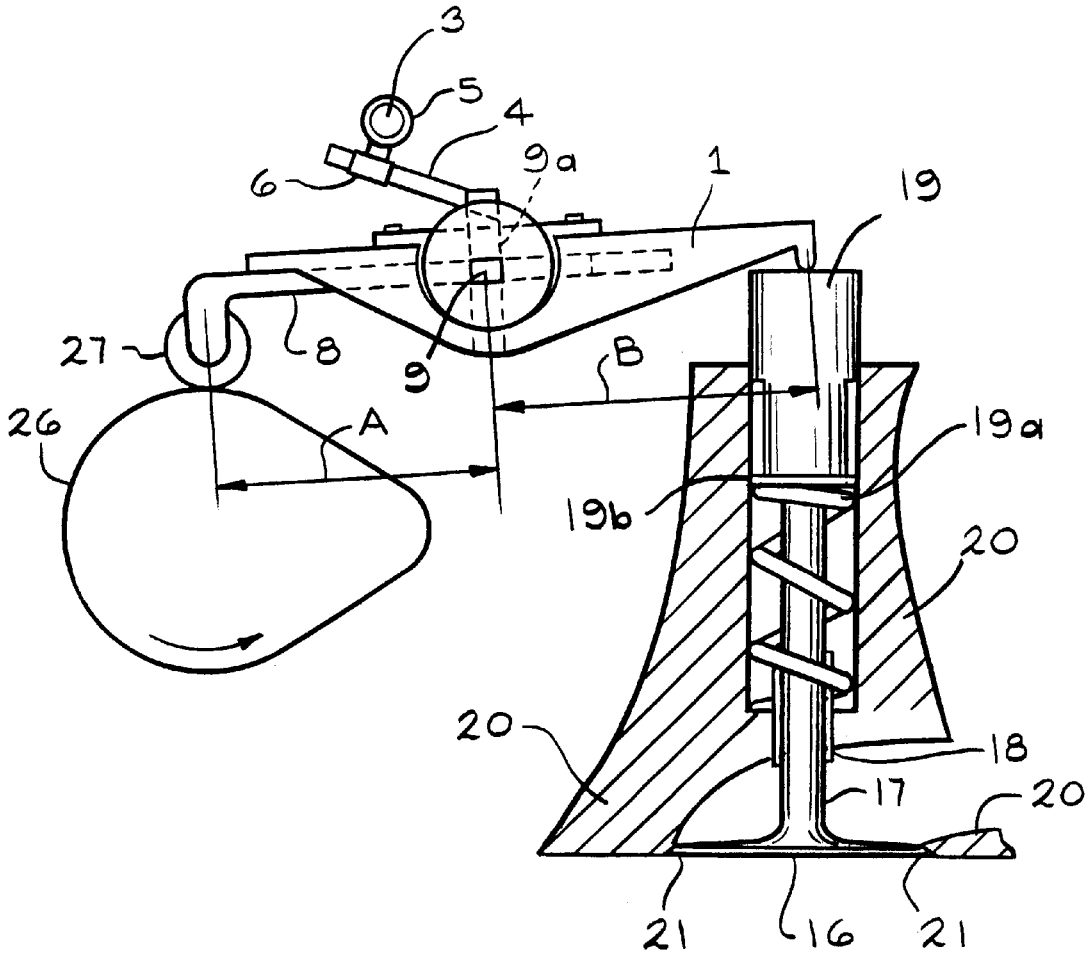
FIG. 5 is a schematic front elevational view of the cam actuated continuous simultaneously variable valve timing and lifting assembly in its closed valve position.

As shown in FIGS. 3, 4 and 5, the cam actuated continuous simultaneously variable valve timing and lifting assembly is shown in its operational stages whereby the valve assembly 19 is shown in its open, advanced, and closed positions, respectively.

As shown in FIGS. 3, 4 and 5, the cam actuated continuous simultaneously variable valve timing and lifting assembly is operatively adapted to engage a rocker arm body 1 which is mounted on a pivot member 2.

As shown in FIGS. 1 through 5, a slider member 8 is retractably mounted within the rocker arm body 1. As shown in FIG. 1, the slider member 8 is provided with an elongate gear slot 8*a* having gear engaging tracks provided therealong which are adapted to operably engage a rotary gear 9 therebetween. As shown in FIG. 2, a rotary gear 9 is provided with a fixed upwardly extending shaft 9*a* which is adapted to be operably engaged at one end thereof with a connector rod 4. A cover plate 10 is provided on the upper surface of the rocker arm body 1 so as to retain the slider 8 and pivot 10 assembly in its operative use position.

As further shown in FIGS. 1 through 5, the connector rod 4 is operatively pivotally connected at the opposite end thereof to a sleeve 6 by use of a connector 7. The sleeve 6 is connected to sleeve 5 which is operably engaged by the actuator 3.

As the actuator 3 moves to the right, it selectively makes the connecting rod 4 turn the rotary gear shaft 9*a* so as to cause the rotary gear 9 to rotate, thus selectively advancing or retracting the slider member 8 as desired.

Figure 6:
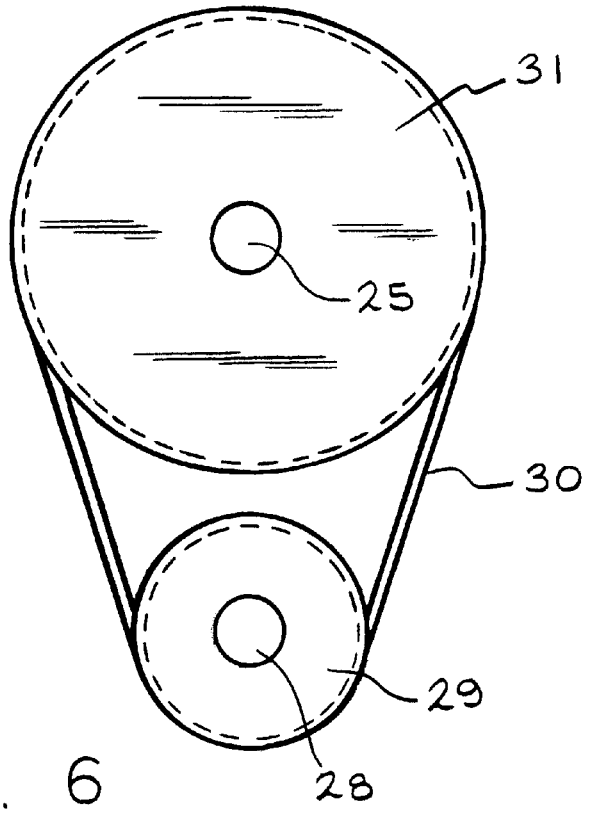
FIG. 6 is a front elevational view of the motor crank driver pulley and the driven cam pulley assembly.
Figure 7:
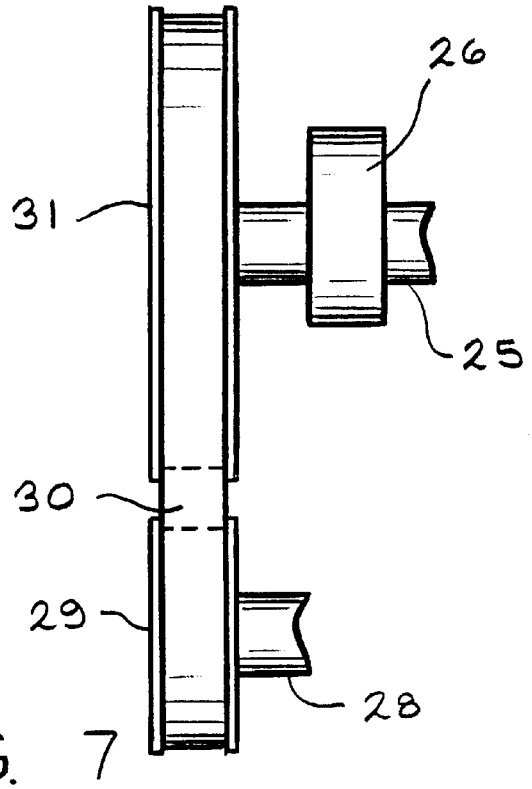
FIG. 7 is a side elevation view of FIG. 6 showing the cam shaft and cam lobe mounted thereon.

In view of the fact that the cam actuated continuous simultaneously variable valve timing and lifting assembly is cam actuated, FIGS. 6 and 7 have been included to show the operation of the cam lobe 26.

As shown in the schematic front elevation view of FIG. 6, the cam shaft pulley sprocket 31 is driven by the crank shaft 28. The timing belt (or chain) 30 in turn drives the cam sprocket pulley 31 which is mounted on the cam shaft 25.

As shown in the schematic side elevation view of FIG. 7, the crank shaft 28 drives the crank shaft pulley 29 which in turn drives the cam sprocket pulley 31 through use of the timing belt (or chain) 30. The cam sprocket pulley 31 is fixedly mounted on the cam shaft 25. The cam lobe 26 is fixedly mounted on the cam shaft 25.

As shown in FIGS. 3, 4 and 5, the cam shaft lobe 26 is positioned to operationally engage the roller 27 provided on the slider 8 which is in operational engagement with one end of the pivotally mounted rocker arm body 1. Thus, the rocker arm body 1 is caused to selectively pivot about the pivot 2. It should be noted that the cam lobe 26 always rotates counterclockwise.

The opposite end of the rocker arm 1 is adapted to pivotally operationally engage the upper surface of the lifter portion 19*c* of the spring biased standard valve assembly 19 so as to selectively move the valve 16 into its (1) normal open position (see FIG. 3), its (2) advanced open position, and (3) its closed position against the valve seat 21 (see FIG. 5). It should be noted that the valve 16 can be selectively positioned in its relative position as determined by the relative pivot movement of rocker arm 1.

The lifter 19*c* is spring-biased within the cylinder head 20 by use of the spring. 19*a* which operatively acts against the spring retainer 19*b*. Thus positioned, the valve 16 moves in response to the selective movement of the rocker arm 1 in response to the cam actuated continuous simultaneously variable valve timing and lifting assembly so as to selectively open and close the valve 16 as desired.

As previously described, the motor 23 driven actuator 3 assembly acts upon the slider 8 so as to selectively cause the slider 8 to advance and retract within the rocker arm body 1 so as to provide cam actuated continuous simultaneously timing and lifting to selectively open and close the valve as desired.

As shown in FIG. 3, the slider 8 is extended outwardly away from pivot 2 so as to act as a normal rocker arm 1 while the timings ° is 0°.

As shown in FIG. 4, in order to advance the timing (angle °), the actuator 3 will cause the slider 8 to retract into the rocker arm body 1 so as to advance the timing and lifting;

As shown in FIGS. 3, 4 and 5, the ratio $$\frac{B}{A}$$

is always smaller than $$\frac{B}{A'}.$$

Lift $L^+$ is always larger than L.

$$\left(\frac{B}{A}\right) < \left(\frac{B}{A}\right)$$

means more lift.

As shown in FIG. 4, the slider 8 is moved fully into the rocker arm 1 while the advance timing angle ° is increased so as to further open the valve to the enlarged opening L+. This provides increased combustion fuel as required.

As shown in FIG. 5, the cam 26 has rotated so as to lower the cam follower roller 27. Thus, the lifter 19 is raised to move the valve 16 into its closed position against the valve seat 21.

As shown in the top schematic view of FIG. 8 and the front elevational schematic view of FIG. 8*a*, a first modified embodiment of the invention showing the hexagonal transfer shaft drive assembly which coacts with a rotating gear 11 to selectively actuate the slider assembly 8. As further shown in FIGS. 8 and 8*a*, a pre-programmed computer controller unit 22 is provided in operative controlling engagement with a motor 23*a* which drives the driving gear 12 which operatively engages the driven gear 11 so as to actuate the transfer shaft 13. The transfer shaft 13 is rotatably mounted on a locator pin 14. The transfer shaft 13 is provided with a spherical ball extension 13*b* provided with rotating gear engaging grooves 13c which operatively engage the gear track 9 provided in the slider 8 so as to selectively actuate the slider 8 as desired.

As more clearly shown in the schematic elevational view of FIG. 8*a*, the hexagonal shaft 13 is provided with an extension 13*a* having a spherical ball 13*b* provided with gear engaging edges 13*c*. This structure is more clearly shown in the schematic partial elevation view of FIG. 12 and the cross-sectional view taken on line 13*b*—13*b* of FIG. 13.

As further shown in FIG. 8*a*, the spherical ball 13*b* engages a hexagonal socket provided in the gear 9 so the edges 13*c* of the spherical ball 13 operationally engages the gear 9 which operationally engages gear track 8*a* so as to selectively move the slider 8 as shown. The use of the spherical ball 13*b* allows the rocker arm 1 to pivot to accommodate the movement of the slider 8 as needed.

As shown in the top schematic view of FIG. 9 and the front elevational view of FIG. 9*a*, a second modified embodiment of the invention is similar to the first embodiment shown in FIGS. 8 and 8*a* but utilizes a screw-type driving gear 12*a* to actuate the driver gear 12 as previously described.

Another third embodiment of the invention is shown in FIGS. 10 and 11 whereby a modified bifurcated connector arm 4*a* is utilized to operatively engage the hexagonal transfer shaft 13. As previously described, the connector rod 4*a* is operatively pivotally connected at the opposite end thereof to a sleeve 6 by use of a connector 7. The sleeve 6 is connected to a sleeve 5 which is operatively engaged by the actuator 3. The modified bifurcated connector arm 4*a* operates as the connector arm 4 shown in FIGS. 1 and 2 and previously described in the specification. The hexagonal transfer shaft 13 is shown in FIGS. 8, 8*a*, 9 and 9*a* and described in the specification. Thus, the third embodiment of the invention combines the foregoing two features.

A cam actuated continuous simultaneously variable valve timing and lifting assembly is provided for operating the valves of an internal combustion engine so as to achieve the horsepower and torque at any RPM with the best efficiency in terms of horsepower and/or fuel economy. This combination includes an internal combustion engine cylinder head assembly. The cylinder head assembly is provided with at least one standard valve assembly. A cam actuated continuous simultaneously variable valve timing and lifting assembly is provided in operative engagement with the cylinder head assembly. A motor drive unit is mounted on the cylinder head assembly is adapted to selectively drive the cam actuated continuous simultaneously variable valve timing and lifting assembly. A pre-programmed computer controller unit is provided in operative controlling engagement with the motor drive unit. A slider actuator is operatively connected to the motor drive unit. The motor drive unit is adapted to selectively extend and retract the slider actuator. A slider is provided in operative engagement with the slider actuator. The slider is provided with a rotary gear receiving track. A rocker arm body is pivotally mounted on the cylinder head. The rocker arm is provided at one end thereof with a slider receiver opening therein. The rocker arm at its opposite end is adapted to selectively operatively actuate the standard valve assembly. A connector arm is provided in operative engagement with the slider actuator. The connector arm is provided with a slider engaging rotary gear which is adapted to operatively engage the slider gear track so as to selectively move the slider. The slider is selectively movable within the rocker arm slider opening. The slider is provided with a cam lobe follower roller at the external end thereof. A crank shaft driven assembly is provided with a cam lobe. The crank shaft driven cam lobe assembly is in operative engagement with the cam actuated continuous simultaneously variable valve timing and lifting assembly. The cam lobe is adapted to operatively engage the slider cam lobe follower roller so as to simultaneously actuate the rocker arm body to selectively pivotally engage the standard valve assembly so as to selectively provide cam actuated continuous simultaneously variable valve timing and lifting assembly whereby the valve assembly can selectively move to open, advanced open and closed valve positions.

A cam actuated continuous simultaneously variable valve timing and lifting assembly is provided for operating the valves of an internal combustion engine so as to achieve the horsepower and torque at any RPM with the best efficiency in terms of horsepower and/or fuel economy, the combination. The combination includes an internal combustion engine cylinder head assembly. The cylinder head assembly is provided with at least one standard valve assembly. A cam actuated continuous simultaneously variable valve timing and lifting assembly is provided in operative engagement with the cylinder head assembly. A motor drive unit is mounted on the cylinder head assembly and is adapted to selectively drive the cam actuated continuous simultaneously variable valve timing and lifting assembly. A pre-programmed computer controller unit is provided in operative controlling engagement with the motor drive unit. A second motor gear drive unit is provided on the cylinder head. The second motor drive unit is provided with a downwardly extending selectively rotatable rotary drive gear engaging rod. A rotary driving gear is fixedly mounted on the rotary driving gear engaging rod so as to be selectively rotatable therewith. A rotary driven gear is provided in an operative engagement with the rotary driving gear so as to be rotatable therewith. A hexagonal transfer shaft drive assembly is fixedly mounted on the rotary driven gear so as to be selectively rotatable therewith. The hexagonal transfer shaft drive assembly is provided with a downwardly extending spherical ball having rocker arm gear engaging means. A rocker arm body is pivotally mounted on the cylinder head. The rocker arm is provided with a spherical ball receiving socket so as to operatively engage the spherical ball. A slider slidably provided in the rocker arm. The slider is provided with gear track means so as to operably engage the spherical ball provided in the rocker arm socket so as to be operatively engaged thereby. The rocker arm is adapted to pivotally actuate the standard valve assembly so as to selectively move to open, advanced open, and closed valve positions.

Another cam actuated continuous simultaneously variable valve timing and lifting assembly as claimed in claim 2 wherein the second motor gear drive unit provided on the cylinder head. The second motor drive unit provided with a downwardly extending selectively rotatable screw type rotary driving gear which is in selective operative engagement with the rotary driven gear.

Various other modifications of the invention may be made without departing from the principle thereof. Each of the modifications is to be considered as included in the hereinafter appended claims, unless these claims by their language expressly provide otherwise.

What is claimed is:

1. In a cam actuated continuous simultaneously variable valve timing and lifting assembly for operating valves of an internal combustion engine, the combination comprising:

an internal combustion engine cylinder head assembly, said cylinder head assembly provided with at least one standard valve assembly;

a cam actuated continuous simultaneously variable valve timing and lifting assembly provided in operative engagement with said cylinder head assembly a motor drive unit mounted on said cylinder head assembly adapted to selectively drive said cam actuated continuous simultaneously variable valve timing and lifting assembly;

a pre-programmed computer controller unit in operative controlling engagement with said motor drive unit;

a second motor gear drive unit provided on said cylinder head, said second motor drive unit provided with a downwardly extending selectively rotatable rotary drive gear engaging rod;

a rotary driving gear fixedly mounted on said rotary driving gear engaging rod so as to be selectively rotatable therewith;

a rotary driven gear provided in an operative engagement with said rotary driving gear so as to be rotatable therewith;

a hexagonal transfer shaft drive assembly fixedly mounted on said rotary driven gear so as to be selectively rotatable therewith, said hexagonal transfer shaft drive assembly having a downwardly extending spherical ball having rocker arm gear engaging means;

a rocker arm body pivotally mounted on said cylinder head, said rocker arm having a spherical ball receiving socket so as to operatively engage said spherical ball;

a slider slidably provided in said rocker arm, said slider provided with gear track means so as to operably engage said spherical ball provided in said rocker arm socket so as to be operatively engaged thereby.

2. In the cam actuated continuous simultaneously variable valve timing and lifting assembly of claim 1, wherein said second motor gear drive unit is provided on said cylinder head, said second motor drive unit is provided with a downwardly extending selectively rotatable screw type rotary driving gear, said screw type rotary driving gear in selective operative engagement with said rotary driven gear.

* * * * *